US012012254B2

(12) United States Patent
Wang

(10) Patent No.: US 12,012,254 B2
(45) Date of Patent: Jun. 18, 2024

(54) MATERIAL LOADING DEVICE

(71) Applicant: TRIPLE WIN TECHNOLOGY(SHENZHEN) CO.LTD., Shenzhen (CN)

(72) Inventor: Jing Wang, Nanning (CN)

(73) Assignee: TRIPLE WIN TECHNOLOGY(SHENZHEN) CO.LTD., Shenzhen (CN)

( * ) Notice: Subject to any disclaimer, the term of this patent is extended or adjusted under 35 U.S.C. 154(b) by 233 days.

(21) Appl. No.: 17/740,477

(22) Filed: May 10, 2022

(65) Prior Publication Data

US 2022/0402652 A1 Dec. 22, 2022

(30) Foreign Application Priority Data

Jun. 16, 2021 (CN) ..... 202110668276.7

(51) Int. Cl.
*B65D 25/00* (2006.01)
*B65D 25/28* (2006.01)

(52) U.S. Cl.
CPC ..... *B65D 25/005* (2013.01); *B65D 25/2858* (2013.01); *B65D 2571/0045* (2013.01)

(58) Field of Classification Search
CPC ..... A47B 57/08; A47B 57/10; B65D 7/10; B65D 25/10; B65D 25/107; B65D 25/24; B65D 25/28; B65D 25/2858; B65D 45/28; B65D 51/248; B65D 85/30; B65D 2203/12; B65D 2251/1016; B65D 2555/02; B65D 2571/0045; B65G 1/02; B65G 1/10; E05B 65/463; E05B 65/467; E05C 19/00
USPC ..... 211/7, 126.15; 206/459.1, 564
See application file for complete search history.

(56) References Cited

U.S. PATENT DOCUMENTS 2,729,498 A * 1/1956 Law ..... B60P 3/007 211/126.15
3,404,929 A * 10/1968 Wright ..... E05B 65/463 312/216
4,925,257 A * 5/1990 Frederiksen ..... E05B 65/463 312/221
5,599,078 A * 2/1997 Dechene ..... E05B 65/464 312/217
10,676,964 B2 * 6/2020 Milligan ..... E05B 65/464
2009/0160298 A1 * 6/2009 Chen ..... E05B 65/463 312/333
2021/0032028 A1 * 2/2021 Yi ..... A47B 57/10
(Continued)

*Primary Examiner* — Joshua E Rodden
(74) *Attorney, Agent, or Firm* — ScienBiziP, P.C.

(57) ABSTRACT

A material loading device with inbuilt stability for the materials and largely immune to operator error includes a loading frame and at least one first locking mechanism. The loading frame defines a receiving cavity with at least one opening. Opposing inner walls of the loading frame define a plurality of slots. The first locking mechanism, comprising guide rod and first locking portions, is disposed at the opening. The first guide rod is disposed outside the receiving cavity, the first locking portions are movably built into at least one sidewall of the loading frame. The first guide rod will drop by gravity to just outside the loading frame, causing the first locking portions to move and lock the plurality of slots. The first guide rod can also be lifted by a parallel surface, moving the first locking portions away to unlock the slots.

20 Claims, 7 Drawing Sheets

(56) References Cited

U.S. PATENT DOCUMENTS

2022/0219868 A1* 7/2022 Zhu ..... B65D 51/248
2022/0402693 A1* 12/2022 Qi ..... B65G 1/02

* cited by examiner

MATERIAL LOADING DEVICE

FIELD

The subject matter relates to material transporting mechanisms, and more particularly, to a material loading device.

BACKGROUND

During production, raw materials may be transported by a loading box. The loading box has a mechanical clip.

However, the mechanical clip needs to be manually opened and closed by an operator. When the raw materials have been loaded into the loading box, the operator may forget to close the mechanical clip, causing the raw materials in the loading box to fall out during transportation. Furthermore, if the operator forgets to open the mechanical clip when the loading box is working with a loading and unloading device, the loading box may be upset or damaged by the loading and unloading device.

BRIEF DESCRIPTION OF THE DRAWINGS

Implementations of the present technology will now be described, by way of example only, with reference to the attached figures.

DETAILED DESCRIPTION

Figure 1:
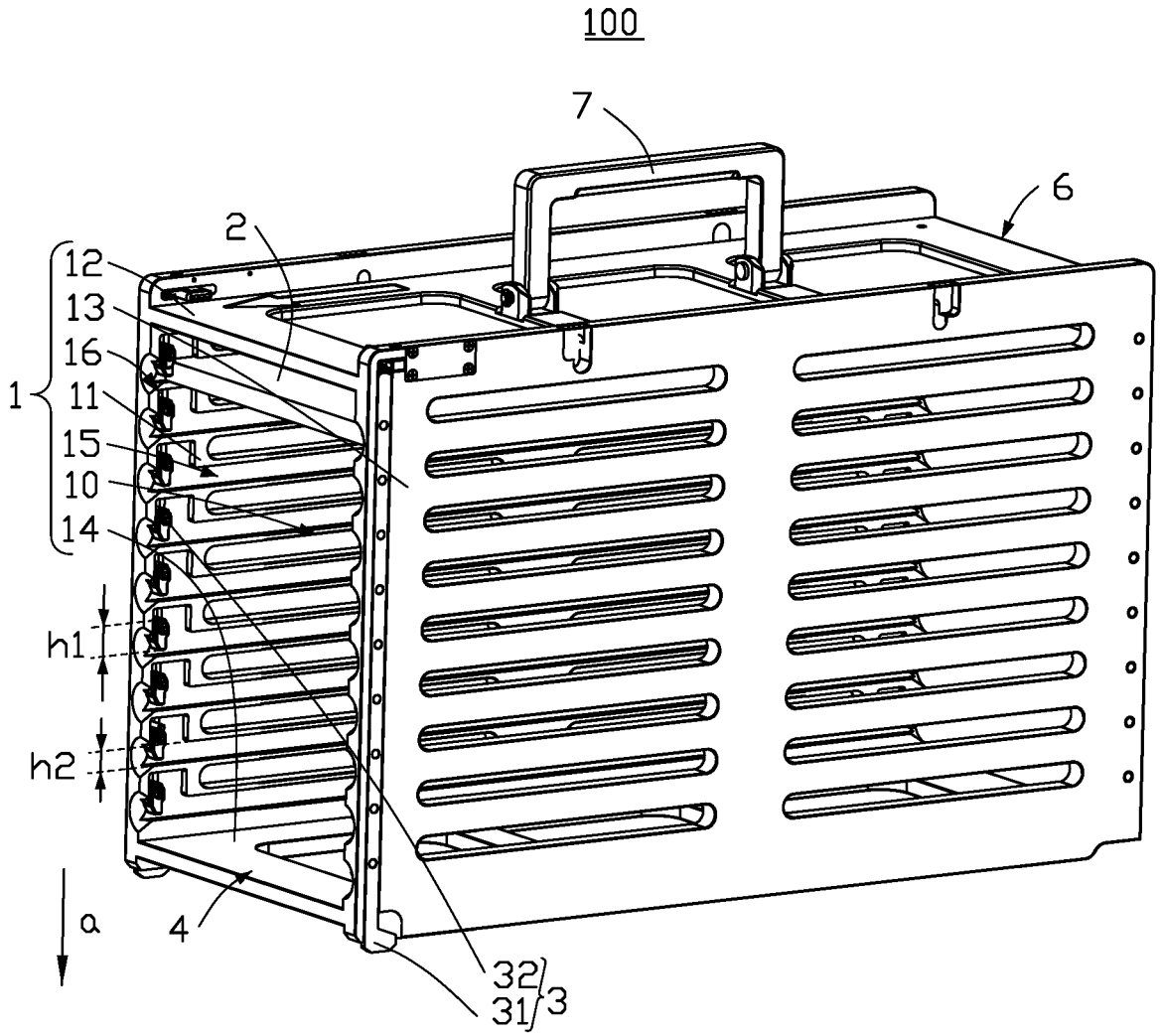
FIG. 1 is a diagrammatic view of an embodiment of a material loading device according to the present disclosure.

It will be appreciated that for simplicity and clarity of illustration, where appropriate, reference numerals have been repeated among the different figures to indicate corresponding or analogous components. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant characteristic being described. Also, the description is not to be considered as limiting the scope of the embodiments described herein. The drawings are not necessarily to scale, and the proportions of certain parts may be exaggerated to better illustrate details and characteristics of the present disclosure.

The term "comprising," when utilized, means "including, but not necessarily limited to"; it specifically indicates open-ended inclusion or membership in the so-described combination, group, series, and the like.

Figure 2:
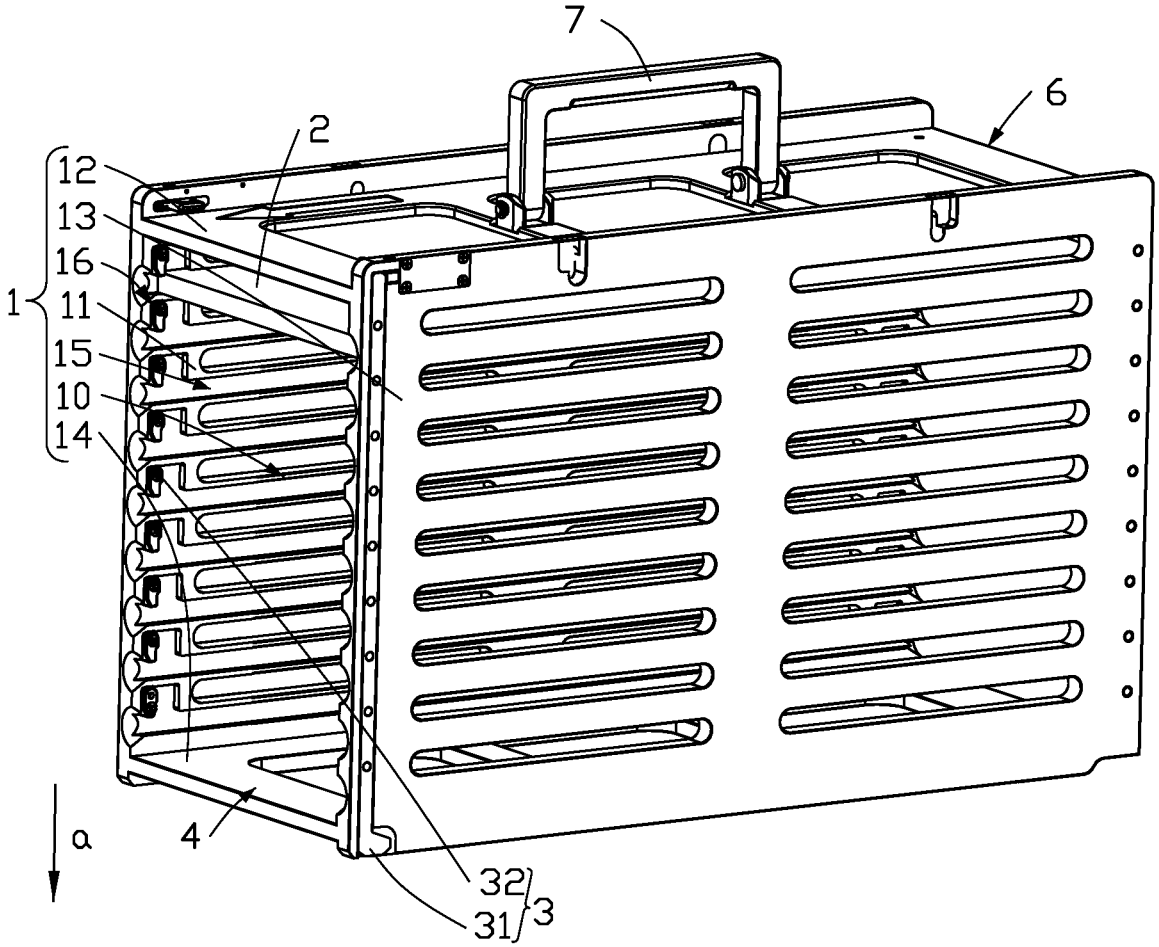
FIG. 2 is a diagrammatic view showing a first locking mechanism unlocking the material loading device of FIG. 1.
Figure 3:
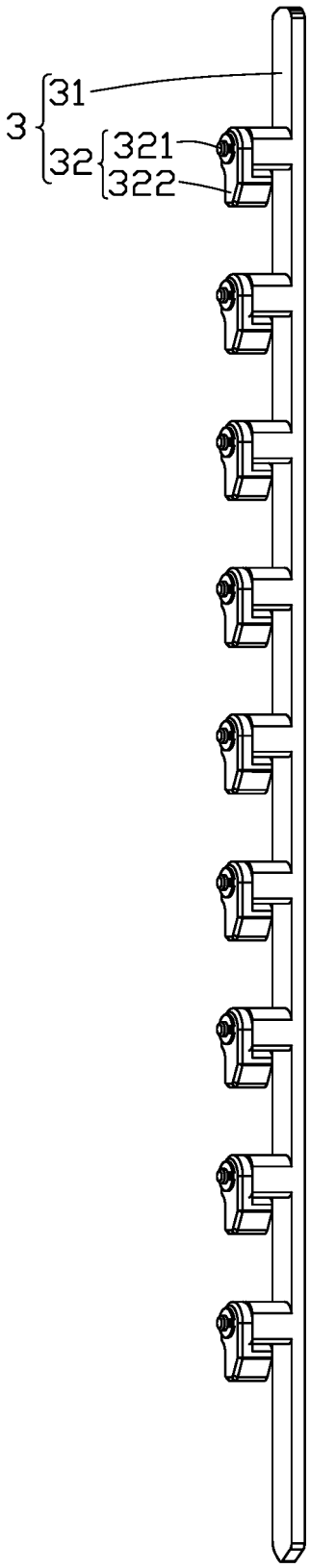
FIG. 3 is a diagrammatic view of an embodiment of the first locking mechanism of the material loading device of FIG. 1.

FIGS. 1 to 3 illustrate an embodiment of a material loading device 100, which includes a loading frame 1 and at least one first locking mechanism 3. The loading frame 1 defines a receiving cavity 10 and at least one opening 4 communicating with the receiving cavity 10. The receiving cavity 10 is used to receive materials. The at least one first locking mechanism 3 is movably coupled to the loading frame 1 at the at least one opening 4. The material loading device 100 further includes a plurality of loading plates 2, which are used to carry materials. Two opposite inner walls of the loading frame 1 define a plurality of slots 15. Two sides of each of the loading plates 2 are inserted into slots 15 on the two opposite inner walls, and the first locking mechanism 3 resists against the loading plates 2 inserted into the slots 15. The loading plate 2 can enter and exit the loading frame 1 through the at least one opening 4. The loading plates 2 received in the slots 15 allow a fixed parallel arrangement of the materials on the loading plates 2 in the receiving cavity 10.

Referring to FIGS. 1 and 2, the first locking mechanism 3 includes a first guide rod 31 and a plurality of first locking portions 32 disposed on the first guide rod 31. The first guide rod 31 extends downwards (direction of gravity, defined as direction "a"). The first locking portions 32 are spaced apart from each other along the direction "a". The first guide rod 31 is disposed outside the receiving cavity 10. Each first locking portion penetrates, and can move within, one sidewall of the loading frame 1. The first guide rod 31 can drop in direction "a" under an action of gravity, so as to move the first locking portions 32 to the slots 15 to lock the loading plates 2. Or, the first guide rod 31 can be driven upwards, opposite to the direction "a", to move the first locking portions 32 away from the slots 15 to unlock the loading plates 2.

Referring to FIG. 1, the loading frame 1 is substantially a rectangular parallelepiped structure formed by a first side plate 11, a second side plate 13, a top plate 12, and a bottom plate 14. The first plate 11 is parallel to the second side plate 13. The bottom plate 14 is opposite to the top plate 12. The first side plate 11, the top plate 12, the second side plate 13, and the bottom plate 14 are connected to each other in that order to define the receiving cavity 10 and the at least one opening 4. The inner walls of the first side plate 11 and the second side plate 13 define the slots 15. The slots 15 on the first side plate 11 are opposite to the slots 15 on the second side plate 13. A loading plate 2 can be loaded and supported horizontally on two opposite slots 15.

Referring to FIG. 1, in an embodiment, the first side plate 11, the top plate 12, the second side plate 13, and the bottom plate 14 define two openings 4 and 6. The two openings 4 and 6 are disposed on opposite ends of the loading frame 1. The first locking mechanism 3 is disposed on the first side plate 11 and/or the second side plate 13 at the opening 4.

In an embodiment, the first locking mechanism 3 is disposed on one end, along an extending direction of the slot 15, of the first side plate 11 and/or the second side plate 13.

In an embodiment, the loading frame 1 is made of metal.

Referring to FIG. 1, at least one of the first side plate 11 and the second side plate 13 defines a plurality of first through holes 16 corresponding to the slots 15. Each first through hole 16 extends along the direction "a". The first guide rod 31 is disposed outside of the receiving cavity 10. One end of each of the first locking portions 32 penetrates a first through hole 16 to connect to the first guide rod 31.

In an embodiment, along the direction "a", one first through hole 16 is located above a slot 15, and the first through holes 16 are located at the end of the slots 15. The first guide rod 31 moves down under the action of gravity, causing the first locking portions 32 to move down in the first through holes 16 and move to the slots 15 to lock the slots 15. The first guide rod 31 moves upwards, to move opposite to the direction "a", causing the first locking portions 32 to move up in the first through holes 16 and move away from the slots 15, to unlock the slots 15.

Referring to FIGS. 1 to 3, each first locking portion 32 includes a first connecting rod 321 connected to the first guide rod 31 and a first buckle 322 disposed on one end of the first connecting rod 321 away from the first guide rod 31. The first guide rod 31 is disposed on a side of the first through hole 16 away from the receiving cavity 10. The first buckle 322 is disposed on another side of the first through hole 16 close to the receiving cavity 10. The first guide rod 31 moves down under the action of gravity, causing the first connecting rods 321 to move down in the first through holes 16, so as to move the first buckles 322 to the slots 15, to lock the slots 15, as shown in FIG. 1. The first guide rod 31 can be lifted up by an external force, causing the first connecting rods 321 to move up in the first through holes 16, so as to move the first buckles 322 away from the slots 15, to unlock the slots 15, as shown in FIG. 2.

In an embodiment, the first connecting rod 321 is substantially perpendicular to the first buckle 322. A free end of the first buckle 322 away from the first connecting rod 321 extends downwards.

In an embodiment, along the direction "a", a height (defined as "h1") of a cross-section of the first buckle 322 is at least equal to a height (defined as "h2") of a cross-section of the slot 15. The height "h1" of the first buckle 322 allows easy locking and blocking of the slot 15 when locking the loading plate 2, for stability during carriage.

In an embodiment, when the slot 15 is locked, a bottom end of the first guide rod 31 goes beyond a bottom surface of the loading frame 1, as shown in FIG. 1. That is, when the slot 15 is locked, the first connecting rod 321 is located at a bottom of the first through hole 16, and the bottom end of the first guide rod 31 extends beyond the bottom surface of the loading frame 1. When the slot 15 is unlocked, the bottom end of the first guide rod 31 is flush with the bottom surface of the loading frame 1, as shown in FIG. 2. In this way, when the material loading device 100 is subsequently placed on a horizontal surface, the first guide rod 31 is automatically pushed up by the horizontal surface when they meet, in an unlocking process.

In an embodiment, when the material loading device 100 is placed on the horizontal surface, or when the material loading device 100 is lifted away from the horizontal surface, the first side plate 11 and the second side plate 13 are substantially perpendicular to the horizontal surface.

In an embodiment, the material loading device 100 includes two first locking mechanisms 3. The two first locking mechanisms 3 are disposed on the first side plate 11 and the second side plate 13 corresponding to the opening 4. The locking of the loading plate 2 in opposite slots 15 is more stable when the first locking portions 32 of the two first locking mechanisms 3 are disposed at the opposite slots 15.

Referring to FIGS. 1 to 3, in use, when the material loading device 100 is lifted, the first guide rod 31 moves downwards under the action of gravity. Thus, the first connecting rods 321 move in the first through holes 16, so as to move the first buckles 322 to the slots 15, to lock the loading plates 2, as shown in FIG. 1. When the material loading device 100 is placed on the horizontal surface, the first guide rod 31 is pushed up by the surface, thus driving the first connecting rods 321 to move upwards. Thus, the first buckles 322 leave the slots 15, opening the slots 15 and unlocking the loading plates 2, as shown in FIG. 2.

Referring to FIG. 1, when opposite ends of the loading frame 1 of the material loading device 100 need to be opened at the same time in some situations, the loading frame 1 needs two openings 4 and 6. Each one of the openings 4 and 6 is provided with at least one first locking mechanism 3.

In an embodiment, two first locking mechanisms 3 are disposed at the opening 4. Ends of the slots 15 at the opening 6 are sealed.

Referring to FIG. 1, the material loading device 100 further includes a lifting and carrying handle 7 disposed on the loading frame 1.

Figure 4:
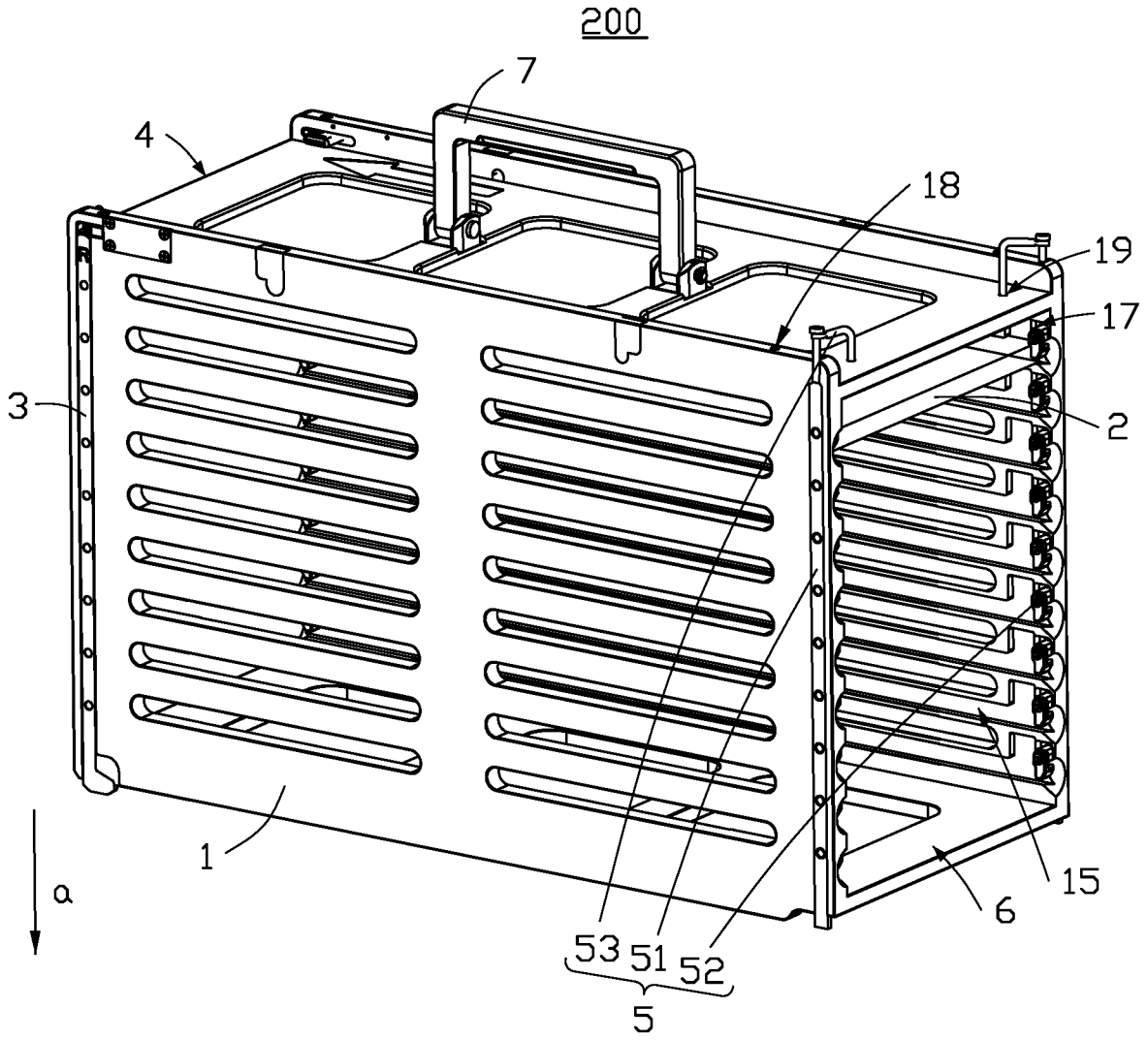
FIG. 4 is a diagrammatic view of another embodiment of a material loading device according to the present disclosure.
Figure 5:
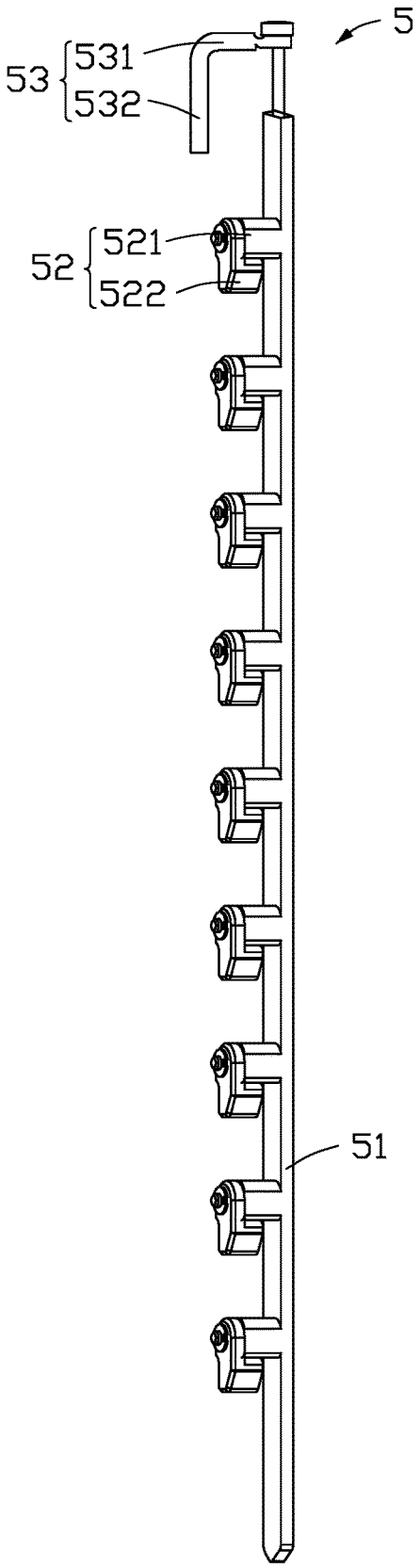
FIG. 5 is a diagrammatic view of an embodiment of a second locking mechanism of the material loading device of FIG. 4.
Figure 6:
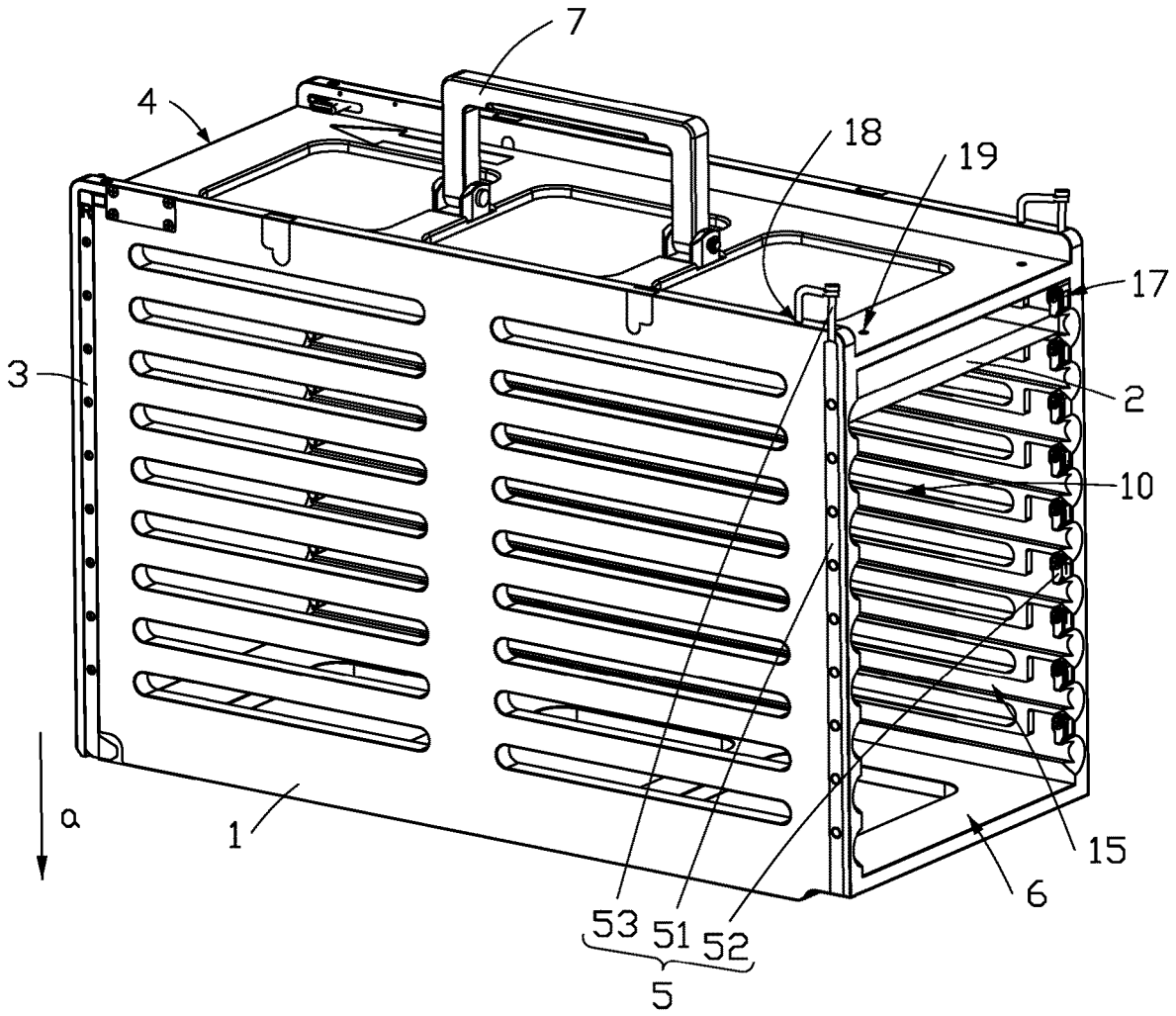
FIG. 6 is a diagrammatic view showing the first locking mechanism and the second locking mechanism unlocking the material loading device of FIG. 4.

Referring to FIGS. 4 to 6, a material loading device 200 is provided in another embodiment. The loading frame 1 defines two openings 4 and 6. The opening 4 is provided with at least one first locking mechanism 3. The material loading device 200 further includes at least one second locking mechanism 5. The at least one second locking mechanism 5 is disposed at the opening 6 away from the first locking mechanism 3.

In an embodiment, the second locking mechanism 5 is a manual locking mechanism. The second locking mechanism 5 is used to lock and unlock the slots 15 manually. One of the openings 4 of the material loading device 200 is automatically locked or automatically opened, and the opposite opening 6 of the material loading device 200 is manually locked or manually opened. Thus, the openings 4 and 6 of the material loading device 200 can connect to other machines, and prevent the loading plate from exceeding a track of the slot 15 when placing the loading plate in the slot 15, rendering the material loading device 200 substantially fool-proof.

Referring to FIGS. 4 to 6, the second locking mechanism 5 includes a second guide rod 51 extending along the direction "a", a plurality of second locking portions 51 disposed on the second guide rod 51, and a lifting lock 53 disposed on a top end of the second guide rod 51. The lifting lock 53 is used to lower or lift the second guide rod 51, so that the second guide rod 51 moves downwards (in the direction "a") or upwards, thereby driving the second locking portions 52 to lock or unlock the loading plates 2 in the slots 15.

In an embodiment, at least one of the first side plate 11 and the second side plate 13 defines a plurality of second through holes 17 corresponding to the slots 15. The second through hole 17 extends along the direction "a". The second guide rod 51 is disposed outside of the receiving cavity 10. One end of each second locking portions 52 penetrates a second through hole 17 to be connected to the second guide rod 51.

In an embodiment, along the direction "a", one second through hole 16 is located above a slot 15, and the second through holes 17 are located at the end of the slots 15. The second guide rod 51 moves downwards, causing the second locking portions 52 to move down in the second through holes 17 and move to the slots 15, to lock the slots 15. The second guide rod 51 moves upwards, opposite to the direction "a", causing the second locking portions 52 to move up in the second through holes 17 and move away from the slots 15, to unlock the loading plates 2.

Referring to FIGS. 4 to 6, a structure of each second locking portion 52 is same as the structure of the first locking portion 31. The second locking portion 52 includes a second connecting rod 521 disposed on the second guide rod 51 and a second buckle 522 disposed one end of the second connecting rod 521 away from the second guide rod 51. The second guide rod 51 is disposed on a side of the second through hole 17 away from the opening 6. The second buckle 522 is disposed on another side of the second through hole 17 close to the opening 6. The second guide rod 51 can move down or move up, causing the second buckles 522 to move down or move up, to lock or unlock the slots 15.

In an embodiment, the second connecting rod 521 is substantially perpendicular to the second buckle 522. A free end of the second buckle 522 away from the second connecting rod 521 is extended downwards.

Referring to FIGS. 4 to 6, the top of the loading frame 1 defines a first clamping position 19 and a second clamping position 18 corresponding to the opening 6. Relative to a slot 15, a height of the first clamping position 19 is lower than that of the second clamping position 18. As shown in FIG. 4, when the lifting lock 53 is clamped in the first clamping position 19, the second buckles 522 operate to lock the slots 15. As shown in FIG. 6, when the lifting lock 53 is clamped in the second clamping position 18, the second buckles 522 operate to unlock the slots 15. When the slot 15 is locked and unlocked, a bottom end of the second guide rod 31 does not extend beyond the bottom surface of the loading frame 1.

Referring to FIGS. 4 to 6, in an embodiment, the lifting lock 53 includes a connecting portion 531 rotationally connected to the second guide rod 51 and a fixing portion 532 connected to the connecting portion 531. When the fixing portion 532 is clamped into the first clamping position 19 by manual lifting, the second buckles 522 lock the slots 15. Manually lifting and clamping the fixing portion 532 into the second clamping position 18 causes the second buckles 522 to unlock the slots 15.

Figure 7:
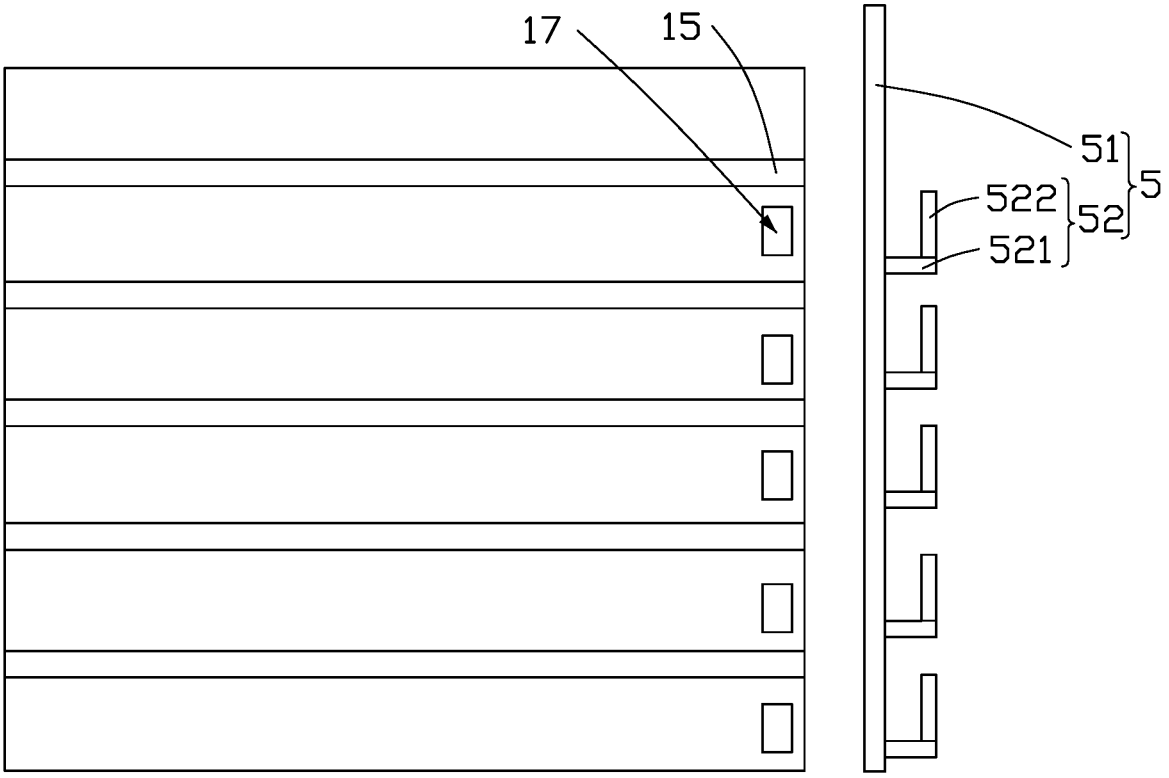
FIG. 7 is a diagrammatic view of another embodiment of a second locking mechanism according to the present disclosure.

Referring to FIGS. 4 and 7, in another embodiment, each second through hole 17 is located below the corresponding slot 15. The second connecting rod 521 is roughly perpendicular to the second buckle 522. The free end of the second buckle 522 away from the second connecting rod 521 extends upward. At this time, manually lifting and clamping the fixing portion 532 into the first clamping position 19 moves the second guide rod 51 upwards to drive the second buckles 522 to lock the slots 15. Similarly, manually lifting the fixing portion 532 and clamping the fixing portion 532 into the second clamping position 18 moves the second guide rod 51 downwards, removing the second buckles 522 from the slots 15 and unlocking the slots 15.

Compared with related arts, a transportation efficiency and stability of the material loading devices 100 and 200 are improved. The first locking mechanism 3 is self-locking by gravity, automatically opening and closing the loading frame 1. The first locking mechanism 3 prevents the loading plates 2 in the loading frame 1 from sliding out, and prevents tilting and falling of the loading frame 1. Moreover, the gravity self-locking operation is convenient, the design of the first locking mechanism 3 is simple, there is no need to connect and power a driving mechanism, and the cost is low. The first locking mechanism 3 is convenient for disassembly and maintenance, and the first locking mechanism 3 is universal and applicable to a variety of material loading devices. The opening 6 of the material loading device 200 is manually locked or manually opened, especially when the material loading device 200 is on a horizontal surface. Thus, the openings 4 and 6 of the material loading device 200 can connect to other machines, preventing the loading plate from exceeding the track of the slot 15 when placing the loading plate in the slots 15, making the device 200 fool-proof.

The embodiments shown and described above are only examples. Even though numerous characteristics and advantages of the present technology have been set forth in the foregoing description, together with details of the structure and function of the present disclosure, the disclosure is illustrative only, and changes may be made in the detail, including in matters of shape, size, and arrangement of the parts within the principles of the present disclosure, up to and including, the full extent established by the broad general meaning of the terms used in the claims.

What is claimed is:

1. A material loading device, comprising:

a loading frame defining a receiving cavity and at least one opening communicating with the receiving cavity, wherein the receiving cavity is configured to receive materials, two opposite inner walls of the loading frame define a plurality of slots; and at least one first locking mechanism disposed at the at least one opening, each of the at least one first locking mechanism comprising a first guide rod extending along a direction of gravity and a plurality of first locking portions disposed on the first guide rod, wherein the first guide rod is disposed outside the receiving cavity, each of the plurality of first locking portions penetrates, and is capable of moving within, a sidewall of the loading frame, an end of the plurality of first locking portions away from the first guide rod extends along the direction of gravity;

wherein the first guide rod is configured to move along the direction of gravity under an action of gravity to drive the plurality of first locking portions to move and lock the plurality of slots; or, the first guide rod is configured to move in an opposite direction of the direction of gravity to drive the plurality of first locking portions to move away from and unlock the plurality of slots.

2. The material loading device of claim 1, wherein the loading frame comprises a first side plate, a second side plate, a top plate, and a bottom plate, the first plate is parallel to the second side plate, the bottom plate is opposite to the top plate; the first side plate, the top plate, the second side plate, and the bottom plate are connected to each other in that order to define the receiving cavity and the at least one opening, an inner wall of the first side plate and an inner wall of the second side plate define the plurality of slots and comprise the two opposite inner walls.

3. The material loading device of claim 2, wherein the at least one first locking mechanism is disposed on the first side plate and/or the second side plate at the at least one opening.

4. The material loading device of claim 2, wherein each of the plurality of first locking portions comprises a first connecting rod connected to the first guide rod and a first buckle disposed on one end of the first connecting rod away from the first guide rod, the first connecting rod penetrates, and is capable of moving within, the sidewall of the loading frame, the first buckle is disposed inside the receiving cavity, and an end of the first buckle away from the first connecting rod extends along the direction of gravity, the first buckle is configured to move to or move away from one of the plurality of slots to lock or unlock the one of the plurality of slots.

5. The material loading device of claim 4, wherein along the direction of gravity, a height of a cross-section of the first buckle is larger than or equal to a height of a cross-section of each of the plurality of slots.

6. The material loading device of claim 4, wherein at least one of the first side plate and the second side plate defines a plurality of first through holes corresponding to the plurality of slots, each of the plurality of first through holes extends along the direction of gravity, the first connecting rod penetrates, and is capable of moving within, one of the plurality of first through holes.

7. The material loading device of claim 6, wherein along the direction of gravity, each of the plurality of first through holes is located above one of the plurality of slots.

8. The material loading device of claim 4, wherein the first guide rod is perpendicular to the first buckle.

9. The material loading device of claim 4, wherein the first guide rod and the first buckle are integrally formed.

10. The material loading device of claim 1, wherein a bottom end of the first guide rod extends beyond a bottom surface of the loading frame when the plurality of slots is locked.

11. The material loading device of claim 2, the loading frame defining the at least one opening including two openings, wherein the at least one first locking mechanism is disposed at one of the two openings.

12. The material loading device of claim 11, the at least one first locking mechanism comprising two first locking mechanisms, wherein the two first locking mechanisms are disposed on the first side plate and the second side plate corresponding to one of the two openings.

13. The material loading device of claim 12, wherein ends of the plurality of slots at another one of the two openings away from the two first locking mechanisms are sealed.

14. The material loading device of claim 11, further comprising at least one second locking mechanism disposed at one of the two openings away from the at least one first locking mechanism, wherein the at least one second locking mechanism is a manual locking mechanism, which is configured to manually open and close the one of the two openings away from the at least one first locking mechanism.

15. The material loading device of claim 14, wherein each of the at least one second locking mechanism comprises a second guide rod extending along the direction of gravity, a plurality of second locking portions disposed on the second guide rod, and a lifting lock disposed on a top end of the second guide rod, the second guide rod is disposed outside the receiving cavity, each of the plurality of second locking portions penetrates, and is capable of moving within, the sidewall of the loading frame, an end of the plurality of second locking portions away from the second guide rod extends along the direction of gravity, the lifting lock is configured to lower the second guide rod, causing the second guide rod moves along the direction of gravity to drive the plurality of second locking portions to move and lock the plurality of slots; or, the lifting lock is configured to lift the second guide rod, causing the second guide rod moves along the opposite direction of the direction of gravity to drive the plurality of second locking portions to move away and unlock the plurality of slots.

16. The material loading device of claim 15, wherein each of the plurality of second locking portions comprises a second connecting rod connected to the second guide rod and a second buckle disposed on one end of the second connecting rod away from the second guide rod, the second connecting rod penetrates, and is capable of moving within, the sidewall of the loading frame, the second buckle is disposed inside the receiving cavity, and an end of the second buckle away from the second connecting rod extends along the direction of gravity, the second buckle is configured to move to or move away from one of the plurality of slots to lock or unlock the one of the plurality of slots.

17. The material loading device of claim 16, wherein along the direction of gravity, a height of a cross-section of the second buckle is larger than or equal to a height of a cross-section of each of the plurality of slots.

18. The material loading device of claim 15, wherein a top portion of the loading frame defines a first clamping position and a second clamping position corresponding to one of the two openings away from the first locking mechanism, relative to each of the plurality of slots, a height of the first clamping position is lower than a height of the second clamping position, the first clamping position and the second clamping position are configured to clamp the lifting lock respectively.

19. The material loading device of claim 18, wherein the lifting lock comprises a connecting portion rotationally connected to the second guide rod and a fixing portion connected to the connecting portion, the fixing portion is configured to clamp into the first clamping position and the second clamping position respectively.

20. The material loading device of claim 1, further comprising a handle disposed on the loading frame.

* * * * *